United States Patent [19]

Watanabe et al.

[11] 4,451,758

[45] May 29, 1984

[54] PICTURE IMAGE DISPLAY DEVICE INCLUDING A ROW OF PARALLEL CONTROL ELECTRODES

[75] Inventors: Masanori Watanabe, Katano; Kinzo Nonomura, Hirakata; Yoshinobu Takesako, Neyagawa, all of Japan

[73] Assignee: Matsushita Electric Industrial Co., Ltd., Kadoma, Japan

[21] Appl. No.: 288,208

[22] Filed: Jul. 29, 1981

[30] Foreign Application Priority Data

Aug. 4, 1980 [JP] Japan ..... 55-107468
Dec. 19, 1980 [JP] Japan ..... 55-180693

[51] Int. Cl.[3] ..... H01J 29/74; H01J 31/00
[52] U.S. Cl. ..... 313/495
[58] Field of Search ..... 313/422, 495

[56] References Cited

U.S. PATENT DOCUMENTS 3,935,500 1/1976 Oess et al. ..... 313/495
4,227,117 10/1980 Watanabe et al. ..... 313/422 X

FOREIGN PATENT DOCUMENTS 55-64353 5/1980 Japan ..... 313/495
55-95261 7/1980 Japan ..... 313/495

*Primary Examiner*—Palmer C. Demeo
*Attorney, Agent, or Firm*—Cushman, Darby & Cushman

[57] ABSTRACT

In a multiple electron beam type flat picture image display apparatus, the disposition of the electrode is improved to the following order:

linear cathode 14, first deflection electrodes 17 for vertical deflection, control electrodes 23 for control of electron beam density, second deflection electrodes 26 for horizontal deflection, acceleration electrodes 28 and an anode 31 of thin metal film formed on the back face (on the inner face) of phosphor screen 30.

Thus, by isolating the vertical deflection electrodes 17 and the horizontal deflection electrode by the control electrodes 23 disposed in between, and by disposing acceleration electrodes 28 at the final stage of electron beam paths, the distortion of image and smallness of spots are improved and vertical deflection energy becomes smaller.

8 Claims, 5 Drawing Figures

FIG.1 (Preceding Invention)

PICTURE IMAGE DISPLAY DEVICE INCLUDING A ROW OF PARALLEL CONTROL ELECTRODES

BACKGROUND OF THE INVENTION

1. Field of the Invention

The present invention relates to an improvement of a multiple electron beam type flat picture image display apparatus and especially concerns the picture image display apparatus having a novel structure capable of reducing distortion of image and reducing the sizes of electron beam spots thereby assuring high quality image display.

2. Description of the Prior Art

Several proposals have been made on multiple electron beam type flat shaped picture display device, for example in the U.S. Pat. No. 3,935,500 and SID 78 Digest pp. 122 to 127. Furthermore, the inventors of the present invention have invented and proposed a multiple electron beam type picture display apparatus described in the specifications of the Japanese Patent Application Sho No. 54-134967 filed on Oct. 18, 1979 (Japanese Patent unexamined Publication Sho No. 56-59441 published May 22, 1981) and also described in the specification of the U.S. Pat. Application of Takesako et al, Ser. No. 250,714, filed Apr. 3, 1981, and European Patent Application No. 81102622.8.

The structure of the picture image display apparatus of the abovementioned described invention is shown in FIG. 1 which is an exploded view of the principal part of the apparatus. The apparatus comprises, as shown from the upper part to the lower part in FIG. 1(*a*), an isolation electrode 2 having a plural number of isolation walls 201 to define oblong isolated spaces 202, a row of predetermined number M (e.g. M=15) of parallel disposed linear thermionic cathodes 1 (i.e., line cathodes, each of which comprises a linear filament line to be heated by a low voltage, e.g., D.C. 10V and electron emissive oxide coating thereon, and hereinafter is referred to as a linear thermionic cathode) each being disposed in the isolated spaces 202, an extractor electrode 3 having a predetermined number N (e.g. N=107) of electron beam passing apertures 3*a* in each row, the rows being disposed below the linear thermionic cathodes 1, a row of control electrodes 4 for controlling beam intensity disposed parallel in a direction perpendicular to those of said linear thermionic cathodes 1 each having electron beam passing openings 4*a* below the apertures 3*a*, an electron beam forming electrode 5 having electron beam passing openings 5*a* below the openings 4*a*, a row of vertical deflection electrodes comprising pairs of common-connected first electrodes 6 and common-connected second electrodes 6', a row of horizontal deflection electrodes comprising pairs of common-connected first electrodes 7 and common-connected second electrodes 7', accelerating electrodes 14, an anode 9 of vapor-deposited thin aluminum film and phosphor screen 10 formed on a face panel 11 of a vacuum enclosure and under said anode 9. Substantially the same potential is impressed on the acceleration electrodes 14 and the anode 9. Every electron beams e, e ..... pass through deflection spaces 62, 62 ..... and 72, 72 ..... defined by the deflection electrodes pairs 6, 6' ..... and 7, 7' ....., respectively disposed regularly in the same order with respect to every electron beams as shown in FIG. 1. In the operation of such multiple electron beam type display apparatus described in the abovementioned specifications, scannings of beam spots on the phosphor screen are made in the known line-at-a-time type scanning, wherein an ordinary time-sequential image signal is converted into a plural number of parallel signals. For example, by taking a case to display an image field raster having 240 picture elements (in the vertical direction) times 321 (in the horizontal direction), with regard to the horizontal scanning of the beam spots the raster is divided into a plural number N of vertically oblong sections, wherein the horizontal scannings are carried out in parallel in all N sections. Then, each section has picture elements of n=321/N in the horizontal direction. For example, when the number N of the vertical sections is 107, the number n of picture element in each section is 3. For such example, 107 beam spots are produced from each linear thermionic cathode and 107 control electrodes are provided in order to control the 107 electron beam intensities. In the apparatus, the horizontal scanning is made by using, for instance, a saw-tooth wave having a horizontal scanning period H applied to the horizontal deflection electrode and in a manner that all the N beam spots are deflected simultaneously to scan in the same direction taking one horizontal scanning period H. The horizontal scanning period H is equal to the horizontal scanning period of the ordinary time sequential television signal. In order for attaining such line-at-a-time-scanning, the ordinary time sequential image signal is preliminarily converted into the N parallel signals of the line-at-a-time type.

The vertical scanning of the described apparatus is made by dividing the raster into a plural number M of horizontally oblong sections, and at first in the first section, for example in the uppermost section, the plural number of beam spots, which simultaneously scan, also scan vertically (downwards). When the vertical scanning in the first section is over and all the beam spots reach the bottoms of the first horizontally oblong sections, then the forming of electron beams from the electron from the first linear thermionic cathode ends and the forming of electron beams from the electrons from the second linear thermionic cathode starts, and the vertical scannings of the beam spots start in the second horizontally oblong section and scan downwards in the same way as in the first section. The vertical scanning is made thus downwards to the bottom or M-th section by, for instance, applying a saw-tooth wave having a period V/M, where V is the vertical scanning period of the ordinary television signal. For the abovementioned example of the raster having the number of vertical picture element of 240, when the number M of the horizontally oblong sections is 15, each of the section has the horizontal scanning lines of a number of m=240/15=16. That is to say, the example apparatus uses 15 linear thermionic cathodes, and each cathode vertically scans to 16 horizontal scanning lines.

In the abovementioned apparatus of FIG. 1, the electron beams taken out from the apertures 3*a* of the extractor electrode 3 are first controlled of their density and then are deflected vertically and horizontally. In such conventional type apparatus, due to interference between the vertical deflection electric field and the horizontal deflection electric field the image formed on the phosphor screen is subject to distortions of barrel form or pin-cushion type and, etc. Therefore, not only the reproduced image is distorted, but also the scanning spot is not sufficiently focussed, thus the size of the spot cannot be made smaller than 0.3 mm. Furthermore, a considerably large amount of energy was necessary for the vertical scanning in each of the vertically divided regions.

SUMMARY OF THE INVENTION

Accordingly, the present invention purports to provide an improved picture image apparatus capable of attaining small distortions in scanning and smallness of scanning spots on the image, and higher efficiency of vertical scanning power.

DESCRIPTION OF PREFERRED EMBODIMENTS

A picture image display apparatus in accordance with the present invention comprises a flat type vacuum enclosure having a transparent face panel containing therein the following disposed in the following order:

- a row of parallel disposed linear thermionic cathodes to produce electron emission,
- an electron beam extracting electrode means which has through-openings to pass electrons of the electron emission therethrough, to form a predetermined number of electron beams of predetermined shapes out of the electron emission,
- a row of first deflection electrodes disposed parallel to the linear thermionic cathodes,
- control electrode means comprising a row of linear electrodes disposed parallel to each other in a direction perpendicular to those of the linear thermionic cathodes,
- a row of second deflection electrodes disposed parallel to each other and also parallel to the linear thermionic cathodes, and
- a phosphor screen and an anode of thin metal film thereon formed on the inner face of the face panel.

Figure 1:
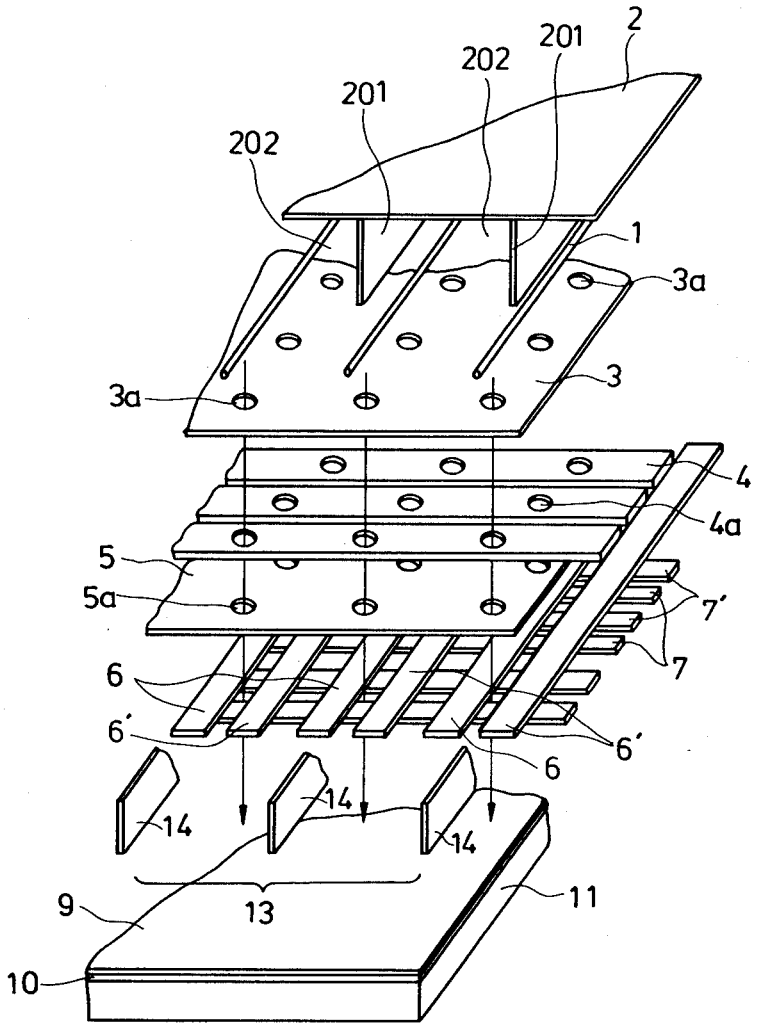
FIG. 1 is an exploded view of a conventional picture image display apparatus.
Figure 2:
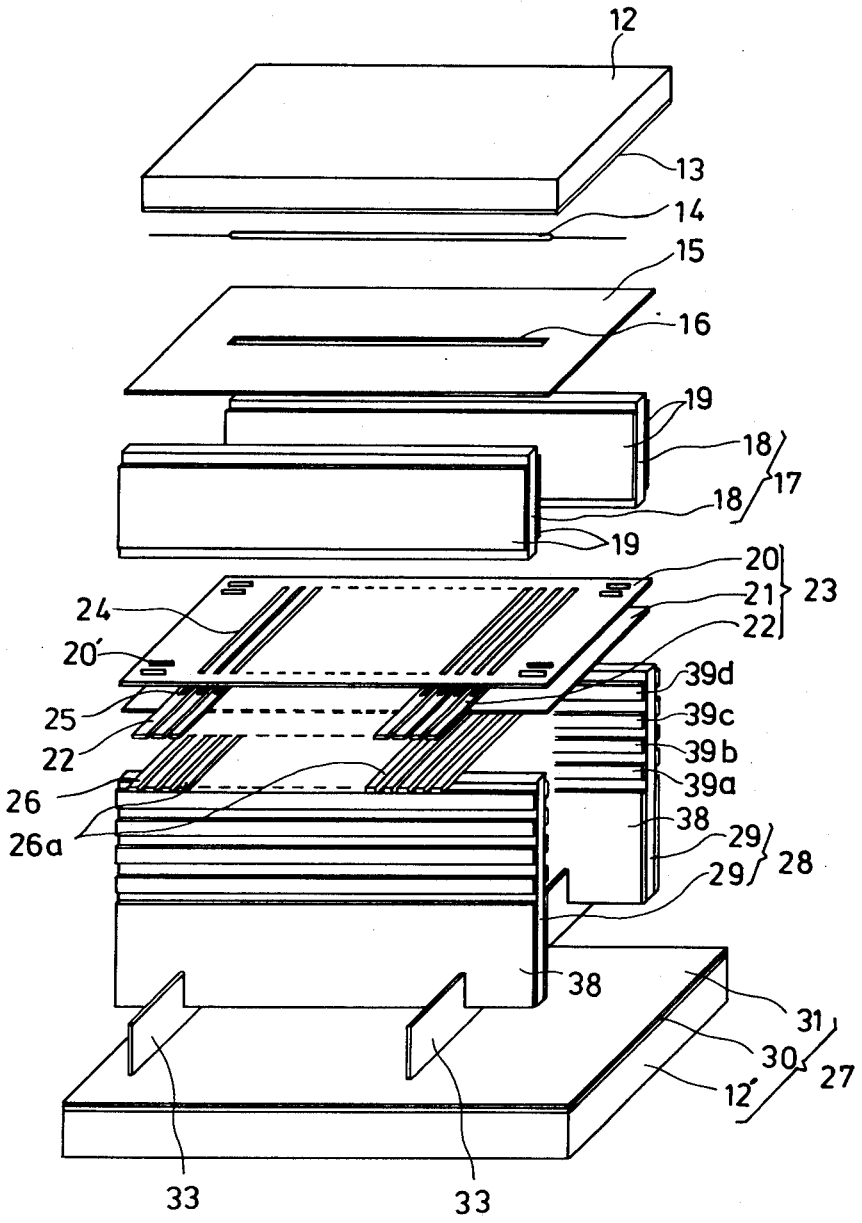
FIG. 2 is an exploded view of a part of an example of picture image display apparatus in accordance with the present invention.
Figure 3:
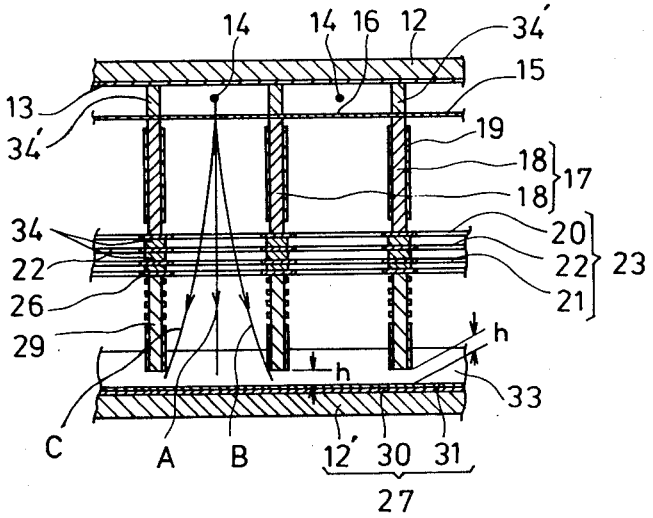
FIG. 3 is a sectional view of the part of picture image display of FIG. 2.

FIG. 2 shows an example of structural configuration of a picture image apparatus in accordance with the present invention. FIG. 2 is an exploded view which shows a very small part of the apparatus and FIG. 3 is a plan view of a small part of the apparatus shown in FIG. 2. The whole apparatus comprises many repetitions of the segments shown in FIGS. 2 and 3 in vertical and horizontal directions of the face panel 12'. As shown in these figures, a flat type vacuum enclosure 12 contains various components therein. The vacuum enclosure 12 is a flat box-shaped enclosure made of glass. A back face electrode 13 is formed on the inner face of a back face of the vacuum enclosure by known vacuum deposition of aluminum. A plurality of linear cathode electrodes 14 are made by coating electron-emissive oxide on 10 to 20 μm diameter tungsten wires and the linear cathode electrodes 14 are disposed parallel to each other and with a predetermined pitch substantially on a plane parallel to said back face electrode 13.

An electron extracting electrode 15 or a first grid having electron passing through-openings 16 is made with a metal sheet disposed substantially parallel to the plane of disposition of the linear cathodes 14. The through-openings 16 are, for instance, linear slits disposed in a parallel row in a manner that the electron beams from respective linear cathodes 14 pass through the openings 16 perpendicularly to the face of the electron extracting electrode 15. When the apparatus is very large, the linear slits 16 can be made in segments of slits, i.e. with reinforcing interruption therein like interrupted slits in chain line rule. Next to the electron extracting electrode, a first deflection electrodes 17 is disposed. The first deflection electrode is for vertical deflection with respect to display image and comprises a parallel row of strip shaped conductors 19 formed on both faces of substrates 18 which are disposed parallel to each other and parallel to said linear cathodes 14, face of the substrates 18 being substantially perpendicular to the electron-extracting electrode 15. Each pair of conductors 19 opposing each other with electron beam passing space inbetween forms a vertical deflection electrode pair, wherein a vertical deflection voltage, for instance, a saw-tooth voltage is impressed across the conductors 19 of the pair so that the electron beam extracted through the slit 16 receives deflection power of the direction perpendicular to the face of the conductors 19. Next to the first deflection electrodes 17, a control means 23 for controlling current of the electron beam is disposed. The control means 23 comprises a second grid 20, a row of control electrodes 22, and a third grid 21 in this order. The second grid 20 has a number of slits 24 perdendicular to the plane of the conductors 19 and also has several engaging means for engaging with the substrates 18. The strip shaped control electrodes 22 are disposed parallel to each other on a plane parallel to the second grid 20, and parallel to and facing the slits 24, and each has slits 25. The third grid 21 is disposed parallel to the second grid 20 and has slits at positions corresponding to those of the slits 24. Next to the control means 23 is disposed a second deflection means 26 comprising a number of electrodes 26*a* for horizontal deflection with respect to a display image. The second deflection electrodes 26*a* are disposed in a manner that deflection spaces defined between a pair of neighboring deflection electrodes 26*a* are disposed under the slits 24 and 25. Horizontal deflection voltage, for instance, a saw-tooth voltage is impressed across the pair of neighboring electrodes 26*a*.

A phosphor screen 30 is formed on a front face panel of the vacuum enclosure 12, and an anode 31 of thin metal film formed by vapor deposition of aluminum is formed on the phospor screen 30.

A space between the second deflection means 26 and the anode 31 may be left empty for a relatively small sized display apparatus. However, in case of a large size display apparatus, in order to resist a great air pressure to the face panel of the vacuum enclosure, it is preferable to provide a reinforcing lattice structure between the inner face of the face panel of the enclosure 12 and the abovementioned electrode assembly structure. For such reinforcing purpose, as well as the belowmentioned purpose of easy deflection, providing of a post-stage acceleration means 28 is advantageous. The acceleration means comprises a row of insulator boards 29 of glass or ceramic and serves as substrate for the accelerator electrode as well as reinforcing frames for holding the inner face of the face panel 12. The insulator boards 29 are disposed parallel to each other and perpendicularly to the face panel 12'. In order to give very rigid structure, as shown by FIG. 3, spacers 34 are disposed between the electrodes 20, 22 and 21, and another spacer 34' is disposed between the first grid 15 and the back face of the enclosure 12, so that the electrode assembly cooperatingly supports the back face 12 and the face panel 12' against large air pressure. These reinforcing spacers 34 and 34' are omitted in FIG. 2 for simplicity of illustration. A wider strip electrode 38 is provided on each substrate at the part nearer to the face panel 12', and narrower strip electrodes 39*a*, 39*b*, 39*c* and 39*d* are provided on each substrate at the part nearer to the second deflection means 26. The wider strip electrodes 38 are impressed with substantially the same potential to that of the anode 31. The narrower strip electrodes 39*a* to 39*d* can be left unconnected to a particular potential as discussed below relative to FIG. 4(*a*). The wider strip electrodes 38 form a row of accelerating electrodes, and in each segment formed by a pair of opposing wider strip electrodes 38, the pair forms, together with the anode 31, an electric field having equipotential faces with sections like catenary curves between the upper edges of the wider strip electrodes 38. The row of insulator boards 29 with the acceleration electrodes 38 is held by frames 33 made of metal sheet disposed on the anode, so that a rigid structure is formed to hold the face panel 12' against atmospheric pressure.

In the sectional view of FIG. 3, a hypothetical plane connecting the linear cathode 14 and the slit shaped through-opening 16 on the first grid 15 is disposed at the center position between each facing pair of the vertical deflection electrodes 19, 19 and between each facing pair of the acceleration electrodes 38, 38, so that the electron beam can be deflected via of paths C and B (corresponding to upwards and downwards) from the non-deflected central position A. The beam A is for the case where voltages of both of electrodes 19, 19 are the same, C is the case where voltage of the left side one of the vertical deflection electrodes is higher than that of the right side one, and B is the case where the voltage of the right side one of the vertical deflection electrodes is higher than that of the left side one.

By providing metal frames 33 of thin metal sheet to hold the substrates 29 of the acceleration electrodes 38 under them, the positionings of the substrates 29 are made accurate, and furthermore, by suitably selecting height "h" of the frame 33, a defect of forming undesirable shadows of electron beams due to the thickness of the substrate 29 and the acceleration electrodes 38 thereon can be eliminated. Thus a beautiful image display substantially without any shadow of the frames or insulation boards 29 is obtainable.

Figure 4:
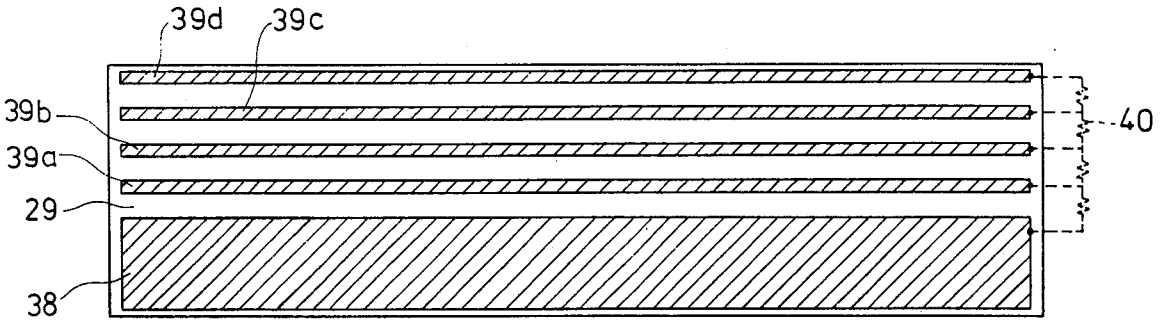
FIG. 4 (*a*) and FIG. 4 (*b*) are respectively enlarged front views of two examples of the acceleration electrodes of the example of FIGS. 2 and 3.
Figure 4:
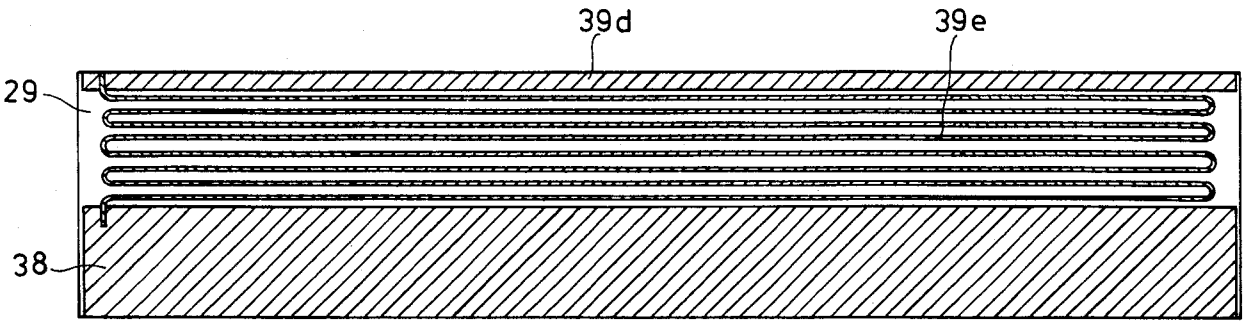

The preferable mode of the acceleration electrode is that as shown in FIG. 4(*a*), a wider stripe shape electrode 38 is disposed at the part nearer to the anode and a predetermined number of parallel narrower stripe shape electrodes 39*a* to 39*d* are disposed at the part nearer to the second deflection mean. The parallel narrower stripe shaped electrodes 39*a* to 39*d* on the insulation boards serve to prevent undesirable local concentration of electric charges on the surface of the insulation boards. As has been described, the wider stripe shape electrode 38 serves to form an electric field having catenary shaped equipotential faces, and the narrower stripe shape electrodes serve to prevent undersirable non-uniformity of electric field due to irregular local deposition of electron charges. Since the insulation board has a very small leakage and the narrower stripe shape electrodes 39*a* to 39*d* are parallel to each other with equal spacing between them, their potentials are supposedly distributed orderly, i.e., with uniform potential difference, even when there is no connection to a particular potential breeder circuit. The potentials of the stripe shape electrodes range from the high potential of the anode, to which the wider stripe shaped electrode 38 is usually connected, to a very low potential of the second deflection means. It is experimentally confirmed that 30% or more of the area of the insulator board 29 should be covered by such electrodes, to prevent the undesirable effect of electron charge accumulation on the insulator boards 29.

However, in order to assure more stable operation, high resistance resistors 40 such as 1000MΩ or more may be connected as shown by dotted lines in FIG. 4(*a*).

FIG. 4(*b*) shows another example where a wire resistor 39*e* of very high resistance is connected in a zigzag way between the upper end narrower electrode 39*d* and the lower end wider electrode 38. The resistance of the extended wire resistor 39*e* should be very high, for instance 100MΩ or more, in order to save waste of current therethrough.

The effect of the post stage acceleration means 28 is boosting of the first (vertical) deflection. This is elucidated by that the electric field of catenary shaped or downward concave equipotential face give the effect of boosting the vertical deflection. Therefore, an effective vertical deflection with a small deflection power becomes possible.

Operation and advantage of the apparatus is as follows:

The first grid or electron extractor electrode 15, the first deflection means 17 and electrode 20 or the second grid of the control means 23 cooperatingly form an electron lens system, and electron beams of very thin thickness like a very thin paper are formed. For instance by impressing potential of −20V (pulse) on the linear cathode 14, potential of +10V on the first grid 15, potential of 0V as the basic potential on the first (vertical) deflection means and potential of +130V on the second grid 20, the width of the electron beam spot on the phosphor screan 30 (which is in the direction with wise of FIG. 3) can be focussed to 0.1 mm or smaller, and the width does not substantially change, thereby assuring a high resolution. And the smallness of the spot is not spoiled even when deflected to the limit of the deflections B and C of FIG. 3.

The second (horizontal) deflection means 26 is exposed directly to the underlying high electric field of the electron beam acceleration, and the electron beam is focussed in the direction perpendicular to the paper of FIG. 3, by an electric field lens whose characteristic is defined by pitch of the electrodes 26*a* and intensity of the acceleration electric field thereunder on the phosphor screen 30. By suitably selecting the focussing condition, the foccussed depth of the electron beam in the above-mentioned direction can be made 0.1 mm or smaller. That is, by disposing the control means 23 between the first (vertical) deflection means 17 and the second (horizontal) deflection means 28, the deflection means satifactorily work independently from the others. Accordingly, by suitably selecting the focussing conditions of the first and the second deflection means, the electron beam spot can be focussed within 0.1 mm for vertical and horizontal directions, and no barrel form distortion and Pin-cushion type distortion is observed.

By providing the post-stage acceleration means 28, that is the electrodes 38 and preferably 39*a* to 39*d* formed on the reinforcing frames 29, the first (vertical) deflection becomes easier and hence power for the vertical deflection can be decreased, and furthermore the rigidity and stability of the apparatus is greatly improved. In another view point, by providing the acceleration electrodes on the face of the reinforcing frame 29, the reliability of the appartus can be greatly improved without fear of undesirable distortion due to undesirable accumulation of electric charges on the reinforcing frame.

What is claimed is:

1. A picture image display device comprising:

a flat type vacuum enclosure having a transparent face panel containing therein the following disposed in the following order:

a row of parallel disposed linear thermionic cathodes to produce electron emission, an electron beam extracting electrode means which has through-openings to pass electrons of said electron emission therethrough, to form a predetermined number of electron beams of predetermined shapes out of said electron emission, a row of first deflection electrodes disposed parallel to said linear thermionic cathodes, control electrode means comprising a row of linear electrodes disposed parallel to each other in a direction perpendicular to those of said linear thermionic cathodes, a row of second deflection electrodes disposed parallel to each other and also parallel to said control electrode means, and a phosphor screen and an anode of thin metal film thereon formed on the inner face of said face panel.

2. A picture image display device in accordance with claim 1 which further comprises:

a row of acceleration electrodes disposed between said row of second deflection electrodes and said anodes, said acceleration electrodes being conductor strips disposed parallel to each other and in planes which are parallel to said linear thermionic cathodes and perpendicular to said anode, and impressed with substantially constant positive potential which is in proximity to that of said linear thermionic cathodes.

3. A picture image display device in accordance with claim 1 wherein said through-openings are a number of slits which are disposed parallel to each other and parallel to said linear thermionic cathodes.

4. A picture image display device in accordance with claim 1 wherein said electron beam extracting electrode, said first deflection electrodes and at least a part of said control electrode means are combined in one unitary assembly.

5. A picture image display device in accordance with claim 2 wherein said acceleration electrode is formed on insulator boards abutting with side edges thereof to said inner face of said face panel.

6. A picture image display device in accordance with claim 5 wherein said acceleration electrode is formed at least at the part of said insulator board which is is proximity to said inner face, covering the surface of said insulator boards at least 30% of their surface area.

7. A picture image display device in accordance with claim 5 wherein at least one pair of additional conductor strips which have a width narrower than that of said conductor strips is further disposed on said insulator board in a manner parallel to said inside face.

8. A picture image display device in accordance with claim 7 wherein a plural number of said narrower additional conductor strips and said conductor strip on one insulator board are connected to each other through a substance of high resistance.

* * * * *